US005161395A

United States Patent [19]

Wethington

[11] Patent Number: 5,161,395

[45] Date of Patent: Nov. 10, 1992

[54] APPARATUS FOR DYEING AND PRINTING MATERIALS HAVING IMPROVED MEANS FOR SUPPORT THEREOF

[75] Inventor: Charles A. Wethington, Pauline, S.C.

[73] Assignees: Milliken Research Corporation, Spartanburg, S.C.; Milliken Research Corporation, Spartanburg, S.C.

[21] Appl. No.: 782,978

[22] Filed: Oct. 24, 1991

[51] Int. Cl.[5] ..... D06B 1/02

[52] U.S. Cl. ..... 68/205 R; 239/397.5

[58] Field of Search ..... 68/205 R; 118/314, 315; 239/397.5

[56] References Cited

U.S. PATENT DOCUMENTS

| | | | |
|---|---|---|---|
| 3,393,411 | 7/1968 | McElveen | 8/151 |
| 3,683,649 | 8/1972 | Takriti et al. | 68/5 D |
| 3,688,530 | 9/1972 | Harris et al. | 68/205 R |
| 3,731,503 | 5/1973 | Appenzeller et al. | 68/205 R |
| 3,892,109 | 7/1975 | Klein et al. | 68/205 R |
| 3,894,413 | 7/1975 | Johnson | 68/205 R |
| 3,937,045 | 2/1976 | Klein et al. | 68/205 R |
| 3,939,675 | 2/1976 | Klein | 68/205 R |
| 3,942,342 | 3/1976 | Klein et al. | 68/205 R |
| 3,942,343 | 3/1976 | Klein | 68/205 R |
| 3,969,779 | 7/1976 | Stewart, Jr. | 8/149 |
| 3,985,006 | 10/1976 | Klein | 68/205 R |
| 4,019,352 | 4/1977 | McCollough, Jr. et al. | 68/205 R |
| 4,033,154 | 7/1977 | Johnson | 68/205 R |
| 4,034,584 | 7/1977 | Klein et al. | 68/205 R |
| 4,055,868 | 11/1977 | O'Neill, Jr. | 8/150 |
| 4,058,991 | 11/1977 | McCollough | 68/205 R |
| 4,059,880 | 11/1977 | Klein | 29/157 |
| 4,095,444 | 6/1978 | Pascoe, Sr. et al. | 68/205 R |
| 4,097,946 | 7/1978 | McCollough | 8/150 |
| 4,116,626 | 9/1978 | Varner | 8/149 |
| 4,148,668 | 4/1979 | Stewart, Jr. | 134/22 C |
| 4,433,811 | 2/1984 | Godfrey | 239/74 |
| 4,434,632 | 3/1984 | McCollough, Jr. et al. | 68/205 R |
| 4,648,250 | 3/1987 | Yabe | 68/5 D |

FOREIGN PATENT DOCUMENTS

| | | |
|---|---|---|
| 0061176 | 9/1982 | European Pat. Off. . |
| 978452 | 12/1964 | United Kingdom . |
| 1201598 | 8/1970 | United Kingdom . |

*Primary Examiner*—Philip R. Coe

*Attorney, Agent, or Firm*—Kevin M. Kercher; H. William Petry; Kevin M. Kercher

[57] ABSTRACT

The present invention is directed to an apparatus to apply dyes to a moving material to print the same which employs dye applicator gun bars to direct a plurality of streams of dye onto the moving sheet in a predetermined pattern, and wherein means are provided for accurately positioning and adjusting the gun bars on their support frame to facilitate accurate placement of the dye streams on the moving material during the printing process.

28 Claims, 5 Drawing Sheets

FIG. —4—

APPARATUS FOR DYEING AND PRINTING MATERIALS HAVING IMPROVED MEANS FOR SUPPORT THEREOF

BACKGROUND OF THE INVENTION

It is known to apply liquids such as dyes to moving textile materials from plural streams which are directed onto the materials and selectively controlled to produce a desired pattern thereon. McElveen U.S. Pat. No. 3,393,411 describes apparatus and process wherein plural streams of liquid are selectively controlled in their flow to provide a distinct pattern on pile carpet.

U.S. Pat. Nos. 3,443,878 and 3,570,275 describe apparatus and process for the patterned dyeing of a moving textile web wherein continuously flowing streams of liquid normally directed in paths to impinge upon the web are selectively deflected from contact with the web in accordance with pattern information. The webs are thus dyed in a desired pattern and the deflected dye is collected and recirculated for use. Each continuously flowing liquid stream is selectively deflected by a stream of air which is discharged, in accordance with pattern information, from an air outlet located adjacent each liquid discharge outlet. The air outlet is positioned to direct the air stream into intersecting relation with the liquid stream and to deflect the liquid into a collection chamber or trough for recirculation.

It can be appreciated that in the application of different colored dyes to the surface of textile fabrics, it is extremely important to place each dyestuff on the fabric accurately, particularly when intricate patterns are being printed and when in situ blending is employed. In dyeing relatively porous textile fabrics, such as pile carpets, it is also important that a carefully controlled amount of dye be applied to each dyed area on the pile surface to ensure optimum penetration of the dye color to the depth of the pile fiber without undesirable spread of the color into adjacent areas of fabric. In printing pile carpets with detailed patterns of colors, it can be appreciated that the liquid jet applicators are very closely spaced relative to each other to permit dyeing in fine detail on the pile surface. In the pattern printing of wide yardage goods of continuous lengths, such as pile carpets wherein the widths may be as much as fifteen feet, it can be appreciated that it is highly desirable and necessary that the very large and heavy liquid applicator gun bars be well supported and accurately aligned throughout their lengths to ensure accurate and proper placement of the jets of dye being applied across the entire width of the goods being printed.

Manifold pipe assemblies are supported in clamps fastened to the bottom of the valve card boxes. On a broadloom printing machine, the manifold pipe assemblies are about fifteen feet long and there are a series of support clamps for each pipe. Each clamp has three setscrews that are spaced equidistantly around the manifold pipe and are used to adjust the radial position of the manifold pipe. One setscrew in each of the two center clamps has a dog-point setscrew that engages a socket in the pipe to prevent axial movement. During cleaning cycles, hot water is pumped through the dye system. The temperature of this water can be seventy-five to eighty degrees Fahrenheit higher than normal dye temperature. The temperature difference causes thermal expansion of the manifold pipe with respect to the valve card box. This expansion is accommodated by allowing the manifold pipe to slide in all clamps except the two center ones with the dog-point set screws. Over time, the sliding of the manifold pipe on the setscrews causes wear on both the screws and the manifold pipe. The wear results in loss of control of the manifold pipe's position, which in turn causes misregistration of the patterns. This problem is extremely acute when utilizing a twenty gauge broadloom machine.

The present invention solves this problem and others in a manner not disclosed in the known prior art.

SUMMARY OF THE INVENTION

The present invention is directed to an apparatus to apply liquids to a moving material to print the same which employs dye applicator gun bars to direct a plurality of streams of dye onto the moving sheet in a predetermined pattern, and wherein means are provided for accurately positioning and adjusting the gun bars on their support frame to facilitate accurate placement of the dye streams on the moving material during the printing process.

It is an advantage of this invention to provide an improved mounting system that allows for thermal expansion to take place without sliding motion or undue stress, which will accurately return to the same position after each thermal cycle.

Yet another advantage of this invention to provide an accurate initial location of a primary manifold pipe assembly and collector plate support member.

Still another advantage of this invention to provide support of a elongate collector plate support member with respect to a primary manifold pipe assembly.

These and other advantages will be in part obvious and in part pointed out below.

BRIEF DESCRIPTION OF THE DRAWINGS

The above as well as other advantages of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
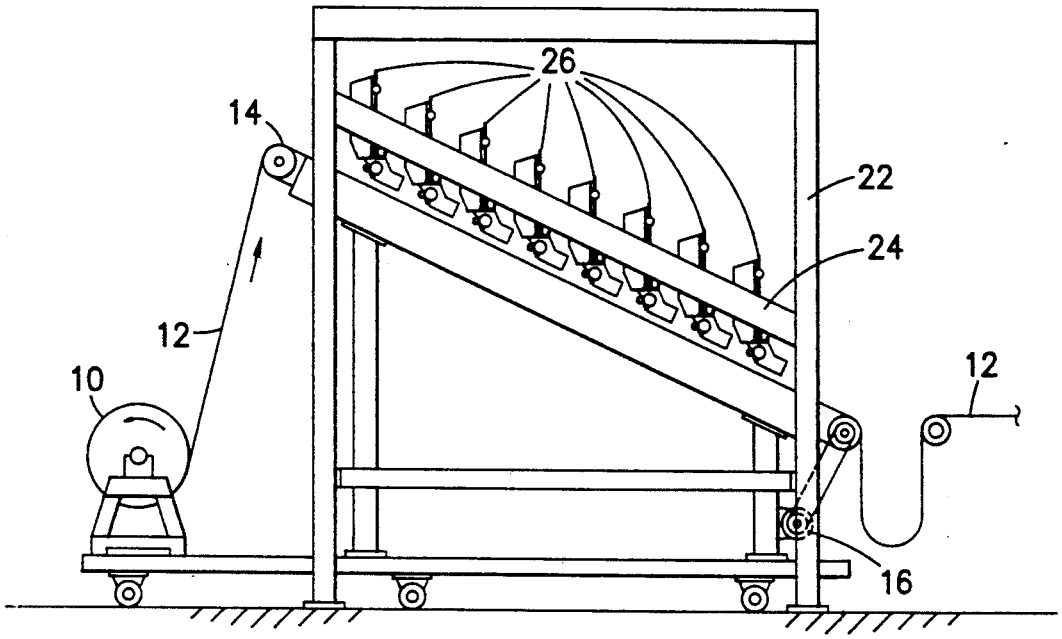
FIG. 1 represents a diagrammatic side view of the array configuration of a dyeing apparatus of a kind for which the instant invention may be adapted, depicting eight dye-emitting arrays positioned above a section of a substrate web to be patterned.

Referring now by reference numerals to the drawings and first to FIG. 1, it will be understood that FIG. 1 depicts, in a side elevational view, a set of eight individual arrays or liquid jet gun bars 26 positioned within frame 22. These liquid jet gun bars 26 form part of a pattern dyeing machine to which the present invention is particularly suited. Each liquid jet gun bar 26 is comprised of a plurality of dye jets, arranged in spaced alignment, which extend generally above and across the width of substrate 12. Substrate 12 is supplied from roll 10 and is transported in turn under each liquid jet gun bar 26 by conveyor 14 driven by a suitable motor indicated generally at 16. After being transported under liquid jet gun bars 26, substrate 12 may be passed through other dyeing-related process steps such as drying, fixing, etc.

Figure 2:
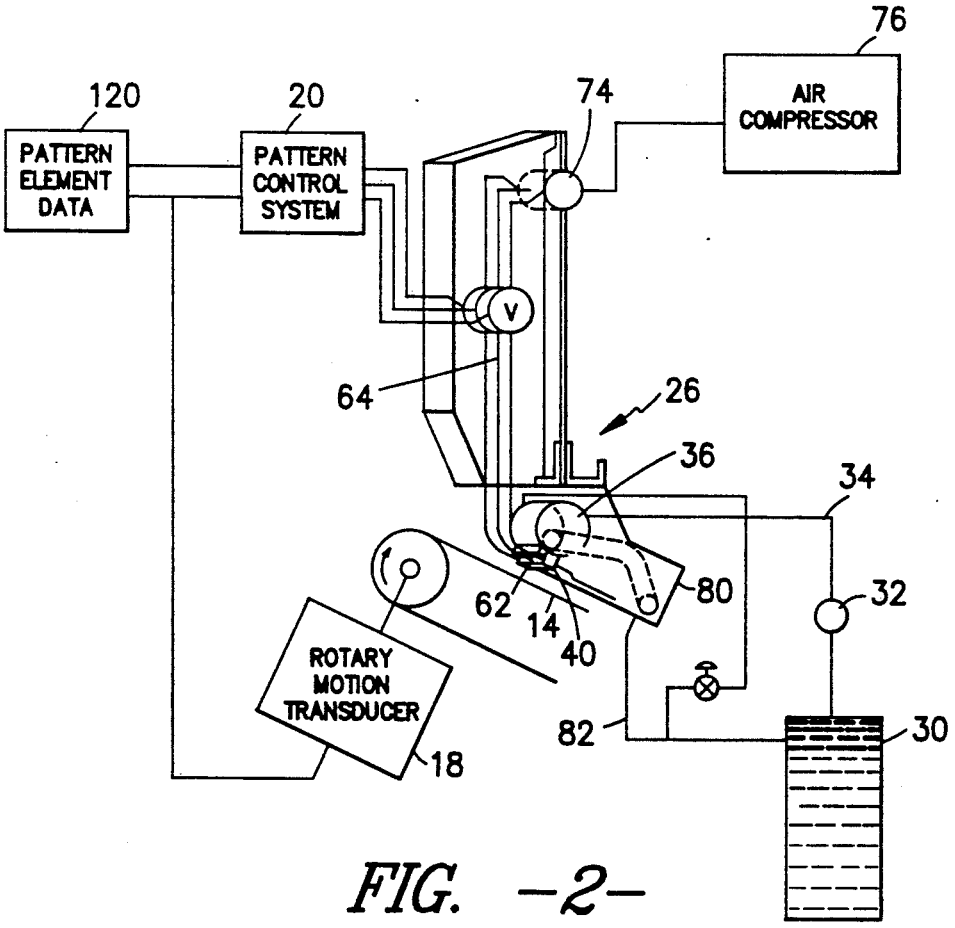
FIG. 2 represents a schematicized diagram of a portion of the apparatus of FIG. 1.

FIG. 2 depicts, in schematic form, a side elevation of one dye-emitting liquid jet gun bar of the machine of FIG. 1. For each liquid jet gun bar shown generally at 26, a separate dye reservoir tank 30 supplies liquid dye under pressure, by means of pump 32 and dye supply conduit means 34, to a primary manifold pipe assembly 36 of the liquid jet gun bar. This primary manifold pipe assembly 36 does not have to be cylindrical. Primary manifold pipe assembly 36 communicates with and supplies dye to dye sub-manifold assembly 40 at suitable locations along their respective lengths. Both primary manifold pipe assembly 36 and sub-manifold assembly 40 extend across the width of conveyor 14 on which the substrate to be dyed is transported. Sub-manifold assembly 40 is provided with a plurality of spaced, generally downwardly directed dye passage outlets 52 (shown, e.g., in FIGS. 3, 4 and 5) positioned across the width of conveyor 14 that produces a plurality of parallel dye streams that are directed onto the substrate surface to be patterned.

As shown in FIGS. 2, 3, 4, and 5, positioned in alignment with and approximately perpendicular to each dye passage outlet 52 in sub-manifold assembly 40 is the outlet of an air deflection tube 62. Each tube 62 communicates by way of an air supply conduit 64 with an individual air valve, illustrated collectively at "V" in FIG. 2, which valve selectively interrupts the flow of air to air tube 62 in accordance with pattern information supplied by pattern control device 20. There is a pattern element data source 120 that sends information to the pattern control device 20. Each valve is, in turn, connected by an air supply conduit to pressured air supplied by air compressor 76. Each of the valves V, which may be of the electromagnetic solenoid type, are individually controlled by electrical signals from a pattern control device 20. The outlets of deflection tubes 62 direct streams of air that are aligned with and impinge against the continuously flowing streams of dye flowing from dye passage outlets 52 and deflect such dye streams into a primary collection chamber or trough 80 (FIG. 2), from which liquid dye may be removed by means of conduit 82 to dye reservoir tank 30 for recirculation.

The pattern control device 20 for operating solenoid valves V may be comprised of various pattern control means. The pattern element data source 120 provides desired pattern information to the pattern control device 20 to operate the solenoid valves. The pattern information is transmitted at appropriate times in response to movement by conveyor 14 that is detected by suitable rotary motion sensor or transducer means 18 operatively associated with the conveyor 14 and connected to control device 20. Details of one means to perform this function may be found in commonly assigned U.S. Pat. No. 4,033,154, issued Jul. 5, 1977, which disclosure is hereby incorporated by reference.

In a typical dyeing operation utilizing such apparatus, so long as no pattern information is supplied by control device 20 to the air valves V associated with the liquid jet gun bar of dye outlets 52, the valves remain "open" to permit passage of pressurized air from air manifold 74 through air supply conduits 64 to deflect continuously all of the continuously flowing dye streams from the dye outlets 52 into the primary collection chamber 80 for recirculation. When the substrate 12 initially passes beneath the dye outlets 52 of the individual liquid jet gun bars 26, pattern control device 20 is actuated in suitable manner, such as manually by operator. Thereafter, signals from transducer 18 prompt pattern information from pattern element data source 120. An example of a means of automatically and electronically changing from one pattern to another is disclosed in U.S. Pat. No. 4,170,883, issued Oct. 16, 1979, which is hereby incorporated by reference. As dictated by pattern information, pattern control device 20 generates control signals to selectively "close" appropriate air valves so that, in accordance with the desired pattern, deflecting air streams at specified individual dye outlets 52 along the liquid jet gun bars 26 are interrupted and the corresponding dye streams are not deflected, but instead are allowed to continue along their normal discharge paths to strike the substrate 12. Thus, by operating the solenoid air valves of each liquid jet gun bar in the desired pattern sequence, a colored pattern of dye is placed on the substrate during its passage under the respective liquid jet gun bar.

As shown in FIG. 1, each liquid jet gun bar 26 extends across conveyor 14 and are attached at each end to the diagonal frame members 24. In the preferred embodiment as shown in FIG. 3, 4 and 5, valve card boxes 100, may be used to house collectively the plurality of individual valves V, as well as the air manifold 74 associated with each liquid jet gun bar.

Figure 3:
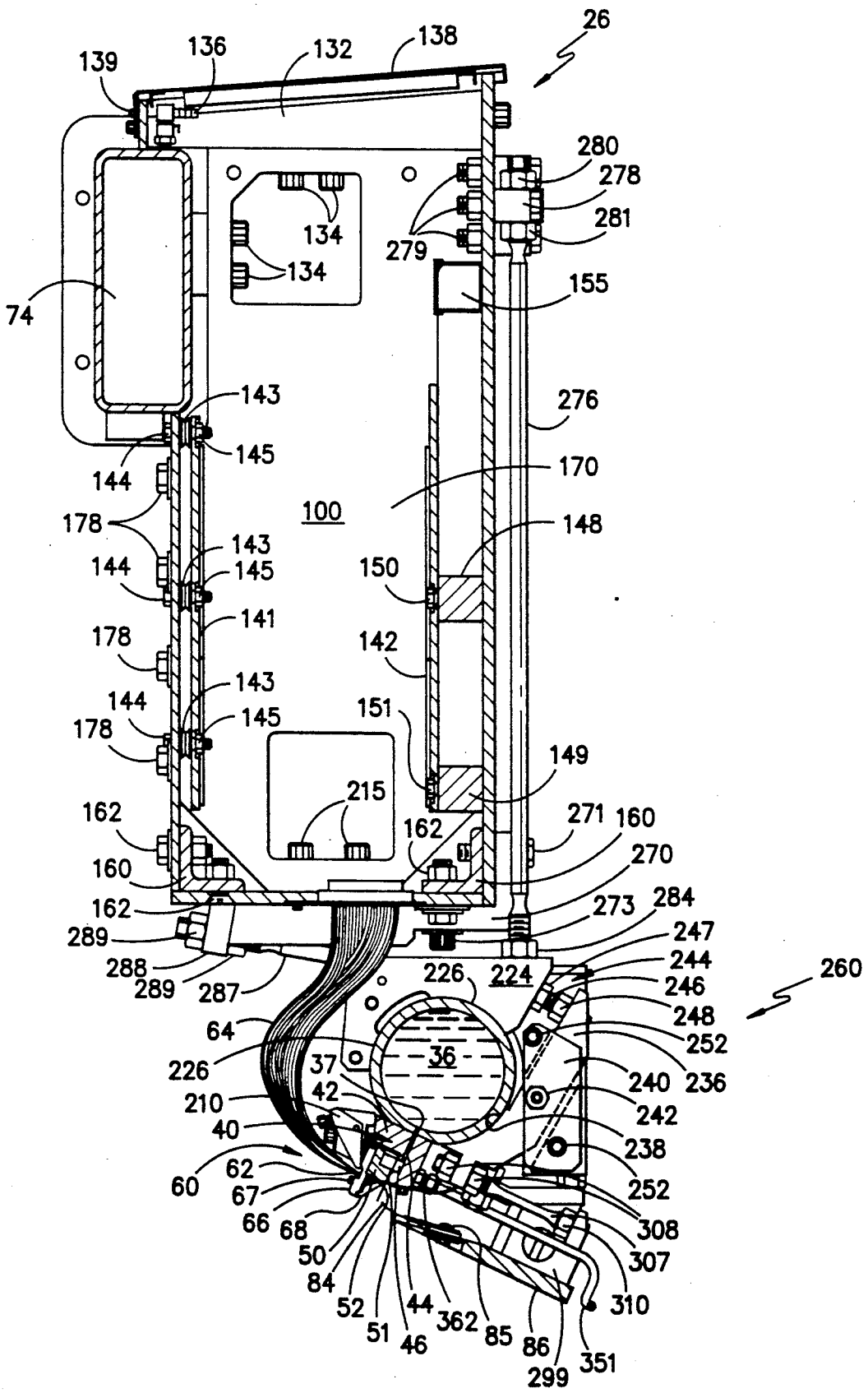
FIG. 3 is a sectional side elevational view taken along line 3—3 of FIG. 6.
Figure 4:
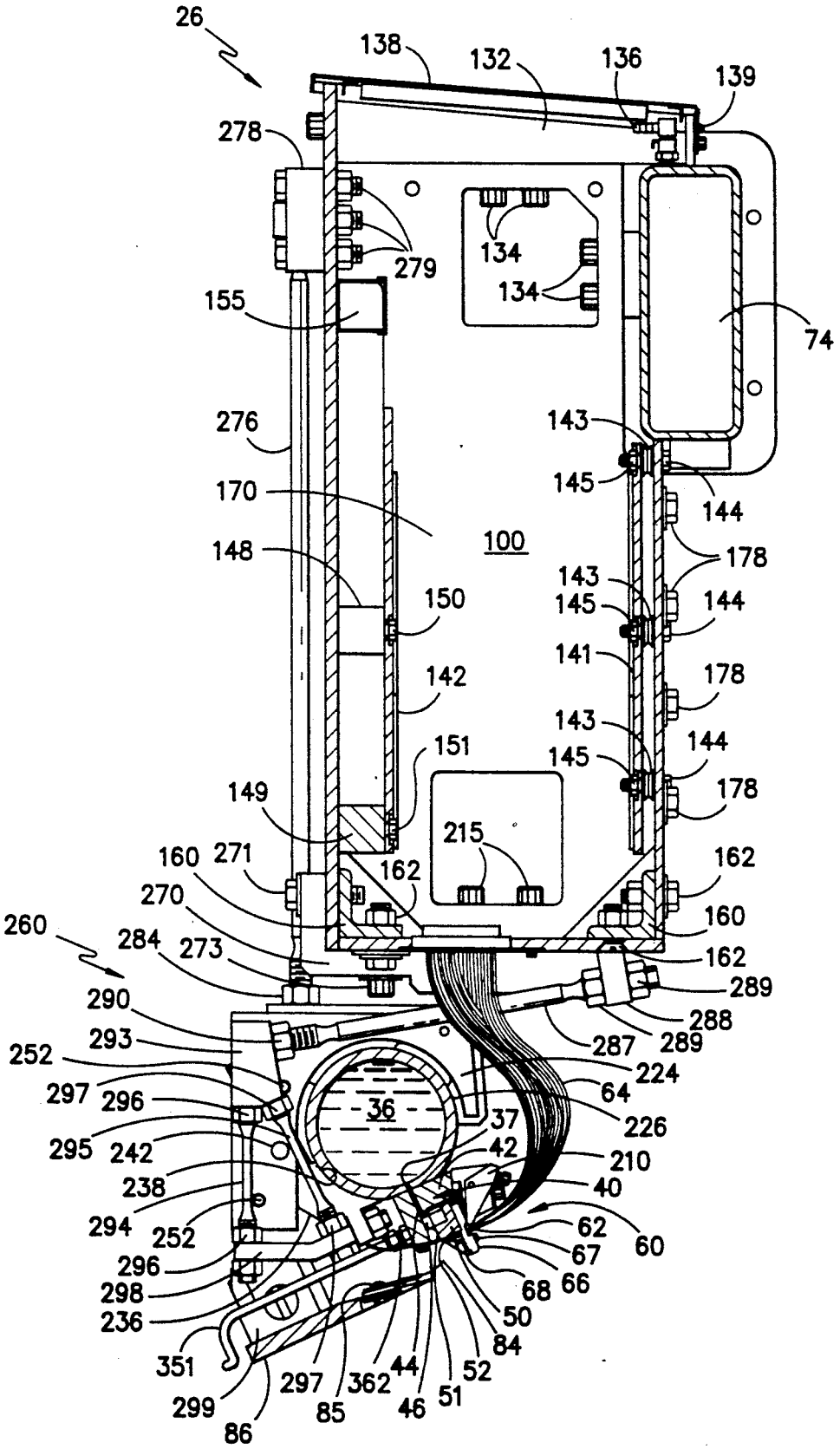
FIG. 4 is a sectional side elevational view taken on line 4—4 of FIG. 6.
Figure 5:
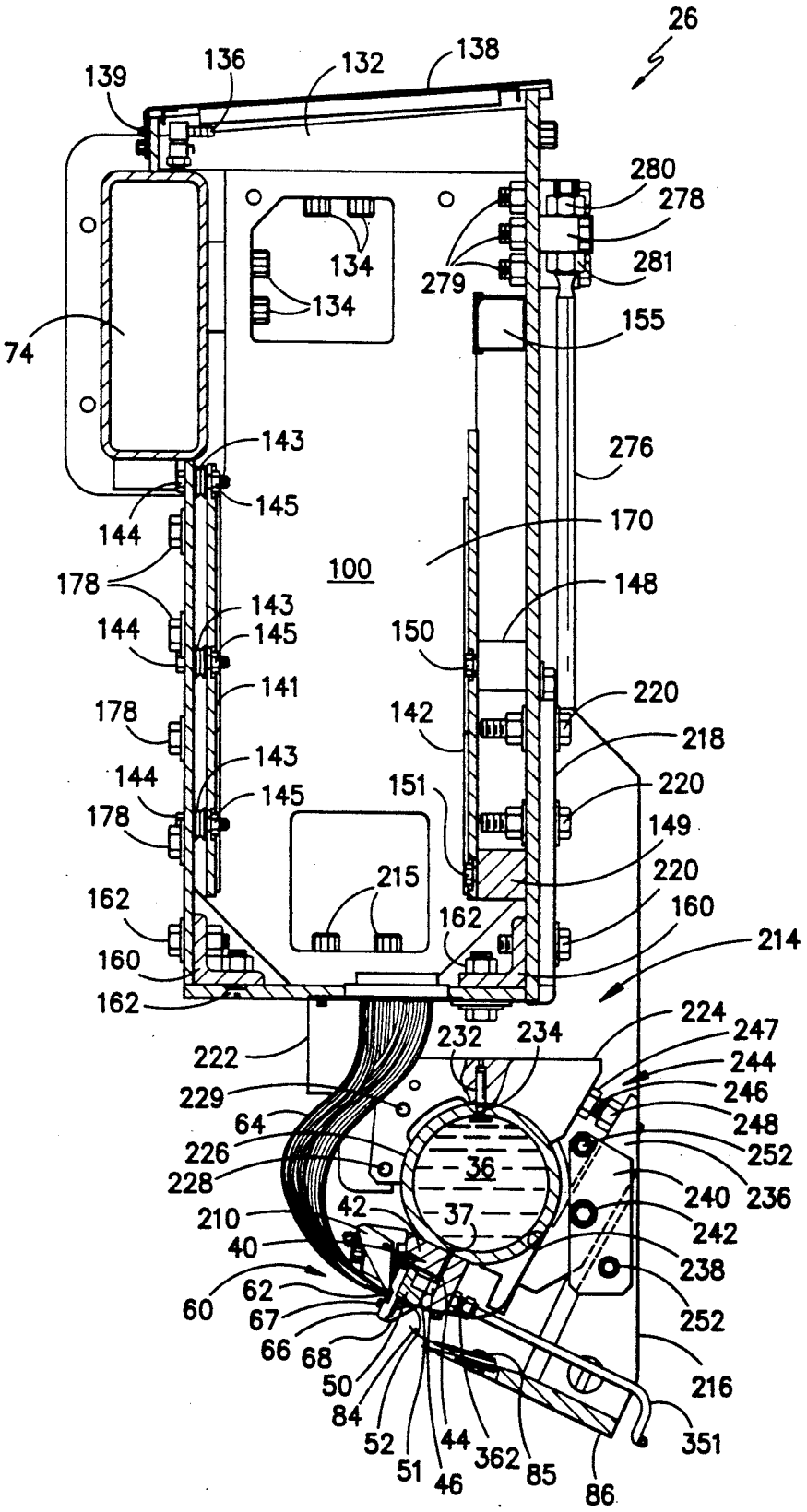
FIG. 5 is a sectional side elevational view taken on line 5—5 of FIG. 6.

As depicted most clearly in FIGS. 3, 4 and 5, primary manifold pipe assembly 36 is comprised of a pipe having a flat mating surface that accommodates a corresponding mating surface on sub-manifold assembly 40. Sub-manifold assembly 40 is comprised of sub-manifold module section 42, grooved dye outlet module 50, and an elongate sub-manifold 46 cooperatively formed by elongate mating channels in sub-manifold module section 42 and outlet module 50. Sub-manifold module 42 is attached to primary manifold pipe assembly 36 by bolts (not shown) or other suitable means so that drilled outlet conduits 37 in the mating surface of manifold assembly 36 and corresponding drilled passages 44 in the mating surface of sub-manifold 46 are aligned, thereby permitting pressurized liquid dye to flow from the interior of manifold assembly to elongate sub-manifold 46.

Associated with the mating face of dye outlet module 50 are a plurality of grooves or channels 51, that when dye outlet module 50 is mated to sub-manifold module 42 as by bolts or other appropriate means (not shown), form dye passage outlets 52 through which uniform quantities of liquid dye from sub-manifold 46 may be directed onto the substrate 12 in the form of aligned, parallel streams.

Associated with dye outlet module 50 is deflecting air jet assembly 60, shown in FIGS. 3, 4, and 5 by which individual streams of air from air tubes 62 may be selectively directed, via an array of valves in valve card box 100 and connecting air supply conduits 64, across the path of respective dye streams. Assembly 60 is comprised of an air supply tube support plate 66 and air tube clamp 68, intended to align and secure individual air deflecting tubes 62 immediately outside dye outlets 52, as shown in FIGS. 3, 4 and 5. By rotating air tube clamp screw 67, the pressure exerted by clamp 68 on air tubes 62 may be adjusted. Spring loaded screw assembly 210 is utilized to apply pressure to air supply tube support plate 66 and is disclosed in U.S. Pat. No. 4,616,794 issued Oct. 14, 1986, which is hereby incorporated by reference. Although not shown, the protruding portion of dye outlet module 50 against which air clamp 68 urges tubes 62 is preferably configured with series of vee-shaped notches into which tubes 62 may partially be recessed. Further details of a similar alignment arrangement may be found in commonly assigned U.S. Pat. No. 4,309,881 which disclosure is hereby incorporated by reference.

When the liquid dye stream is deflected, the liquid dye exiting from dye passage outlets 52 is directed into primary dye collection chamber 80 shown in FIG. 2, which may be formed of suitable sheet material such as stainless steel and extends along the length of the liquid jet gun bar 26. Associated with collection chamber 80 is the primary dye collector plate 84 that is comprised of a thin flexible blade-like member that is positioned parallel and closely adjacent to dye passage outlets 52. Primary dye collector plate 84 may be adjustably attached at spaced locations along its length, as by bolt and spacer means 85 to a collector plate support member 86 that is both wedge-shaped and elongate, which forms an extension of the floor of primary collection chamber 80 and that is sharpened along the edge of the primary dye collector plate 84 nearest the outlets 52 of dye discharge channels 51 and extends along the length of liquid jet gun bar 26. Any suitable adjustment means by which a thin, blade-like collector plate 84 may be mounted under tension along its length and aligned with the axes of dye outlet module grooves 51 may be employed; one such means is disclosed in commonly assigned U.S. Pat. No. 4,202,189 which disclosure is hereby incorporated by reference.

Figure 6:
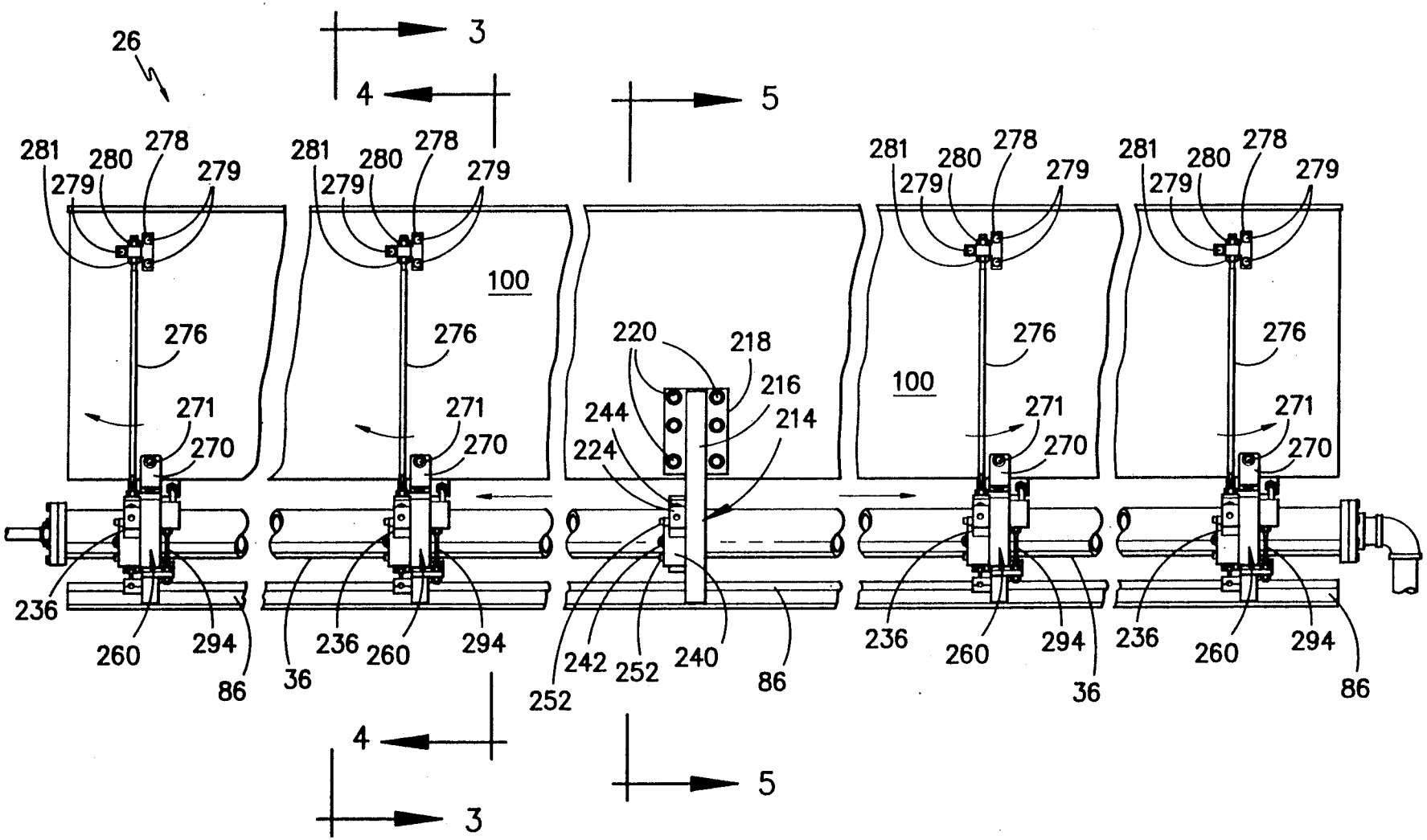
FIG. 6 is a fragmentary rear elevational view of the jet dye applicator detailing the five support means for the manifold pipe.

As shown in FIGS. 5 and 6, there is a single non-adjustable center bracket assembly generally indicated as numeral 214 that is used to locate the primary manifold pipe assembly 36 and the collector plate support member 86 with respect to the valve card box 100. This is a fixed amount that is non-adjustable and whose position is determined by machining. This single non-adjustable center bracket 214 is of a single unitary construction and is comprised of a vertically elongate portion 216 with a plate portion 218 on each side of the vertically elongate portion 216 with holes in which bolts 220 threadedly attach the plate portion 218 to the valve card box 100. A pair of bolts 220 also penetrate a L-shaped bracket 160 located at the bottom of the valve card box 100. This center bracket 214 also has a horizontal portion 222 that conforms to the underside of the valve card box 100. Attached to this horizontal portion 222 is a clamp assembly 224 extending to the left as shown in FIG. 6, having an arcuate surface portion 226 that is in direct contact with the primary manifold pipe assembly 36. Clamp assembly 224 is attached to the center bracket 214 by a series of bolts, rivets, or any of a wide variety of attachment means 228, 229 including adhesives, welding, brazing and so forth, as is typical throughout this Application. Within clamp assembly 224 is a pipe angle dowel pin 232 that fits within a recess 234 within the primary manifold pipe assembly 36. This pipe angle dowel pin 232 serves to locate the primary manifold pipe assembly 36 axially and sets the angle of the dye passage outlets 52. This angle dowel pin 232 positioned in recess 234 also serves to restrain the axial movement of the primary manifold pipe assembly 36. The center of the primary manifold pipe assembly 36 is determined from one corner of the valve card box 100 by the clamp assembly 224.

There is a pivoting clamp arm 236 having an arcuate surface portion 238 to secure said elongate dye manifold pipe assembly 36 against the arcuate surface 226 of said clamp assembly 224 and restrain said dye manifold pipe assembly 36 from radial movement. There is a plate 240 attached by means of bolts 252 or equivalent to the clamp assembly 224. This clamp arm 236 is pivoted by means of pin 242. The amount of pressure applied to the pivoting clamp arm 236 in holding arcuate portion 238 against the dye manifold pipe assembly 36 is controlled by clamp screw assembly 244 comprising of a bolt 246 embedded in clamp arm 236 and having a bolt head 247 and a nut 248 attached thereto. When the bolt head 247 is unscrewed, it forces the bolt head 247 against the clamp assembly 224 to put pressure on the dye manifold pipe assembly 36.

As shown in FIGS. 5 and 6, the collector plate support member 86 is attached to the vertically elongate portion 216 of the single non-adjustable center bracket 214. This provides a fixed, non-adjustable mount position for collector plate support member 86 with a position and angle determined by machining.

There are also a plurality of primary high velocity bypass tubes 351 that divert fluid into the collection chamber 80. The tubes 351 attach by means of conventional hardware (i.e., tubing fitting) 362 to the sub-manifold module 42. The tubes can be constructed out of as metal, plastic, rubber, and so forth. There are a series of bolts 178 along the left side of the valve card box 100 as shown in FIG. 3 utilized for structural support.

As shown in FIGS. 3, 4, and 5, air manifold 74 is attached to the valve card box 100 by means of welding but could be attached by adhesives, brazing or other means of conventional hardware attachment as is typical throughout this Application. There are a series of valve card box partitions 170 located throughout the liquid jet gun bar 26. The valve card box 100 includes a trapezoidal valve card box partition section 132 attached by bolts 134 or equivalent to the top of the valve card box partition 170. Bolts 215 secure the bottom of the valve card box partition 170 to the bottom of the valve card box 100. There is a fitting 136 attached to the air manifold 74. The top of each valve card box 100 has a lid 138 pivotally mounted by means of a hinge 139. There are a plurality of inner rails 141 and 142 within the valve card box 100. Rail 141 is mounted to the side of the valve card box 100 by means of a bolt 144, bevel spring spacer 143 and nut 145. Rail 142 is mounted to an upper block-type spacer 148 and a lower block-type spacer 149 by means of bolt 150 and 151, respectively. Valve cards (not shown) that have the valves V mounted thereon, are designed to slide into these rails. There is a rectangular conduit 155 that contains and feeds wires to the valve cards. There are two L-shaped brackets 160 located at the bottom corners of the valve card box 100 and attached to the valve card box 100. This attachment is accomplished by means of nut and bolt combinations 162 or other equivalent means except for L-shaped bracket 270 which is attached by bolt 271 and center bracket 214 which is attached by bolt 220.

Four other adjustable mounting assemblies are generally indicated as numeral 260 as shown in FIGS. 3 and 4 for the fifteen foot broadloom machine. For a carpet tile machine, only two other adjustable mounting assemblies are needed. These adjustable mounting assemblies 260 are spaced along the length of the primary manifold pipe assembly 36, one near each end and the other two halfway between them and the single non-adjustable center bracket assembly 214. Unlike the center bracket assembly 214, each of the adjustable mounting assemblies 260 have an L-shaped bracket 270 located directly underneath the valve card box 100 and attached underneath by means of bolt 273 and on the vertical portion of L-shaped bracket 270 by bolt 271 on the right side of valve card box 100 in FIG. 3 or on the left side of valve card box 100 in FIG. 4. Bolt 271 on the vertical portion of L-shaped bracket 270 is also shown in FIG. 6 and is attached to L-shaped bracket 160 located at the bottom corner of the valve card box 100. Each of the adjustable mounting assemblies 260 like the center bracket assembly 214 includes a clamp assembly 224 having an arcuate surface portion 226 that is in direct contact with the primary manifold pipe assembly 36. A pipe angle dowel pin 232 may be used with the adjustable mounting assemblies 260 as is done with the single non-adjustable center bracket, however, this is entirely optional.

There is also a pivoting clamp arm 236 having an arcuate surface portion 238 to secure said elongate dye manifold pipe assembly 36 against the arcuate surface 226 of said clamp assembly 224. There is also a plate 240 attached by means of bolts 252 or equivalent to the clamp assembly 224. This clamp arm 236 is pivoted by means of pin 242. The amount of pressure applied to the pivoting clamp arm 236 in holding arcuate portion 238 against the dye manifold pipe assembly 36 is controlled by clamp screw assembly 244 comprising of a bolt 246 embedded in pivoting clamp arm 236 and having a bolt head 247 and a nut 248 attached thereto. When the bolt head 247 is unscrewed, it forces the bolt head 247 against the clamp assembly 224 to put pressure on the dye manifold pipe assembly 36. There is a substantially vertical rod 276 that is threadedly connected to the clamp assembly 224 and locked with a jam nut 284 and connected to the valve card box 100 by means of a ninety degree T-shaped support bracket 278 bolted to and located substantially near the top of the valve card box 100. The ninety degree support bracket 278 is attached to the valve card box 100 by series of three nut and bolt combinations 279 or equivalent. There is an upper nut 280 and lower nut 281 to threadedly attach the substantially vertical rod 276 to the ninety degree T-shaped support bracket 278 and are utilized for adjustment.

There is a substantially horizontal rod 287 attached to the L-shaped bracket 270 by means of a support brace 288 that wraps around the substantially horizontal rod 287 with a pair of hex nuts 289 on each side of the support brace 288 for adjustment purposes. The other end of the substantially horizontal rod 287 is threadedly attached to the clamp assembly 224 with a hex nut 290 utilized as a jam nut. Rods 276 and 287 do not have to be horizontal and vertical but merely transverse to each other with the optimal condition being a substantially perpendicular relationship. Furthermore, the clamp assembly 224 is not necessary with direct attachment with rods 276 and 287 as a possible means of support. These adjustable mounting assemblies 260 serve to hold the primary manifold pipe assembly 36. The rods 276 and 287 locate the primary manifold pipe assembly 36 radially. The angle of the dye passage outlets 52 are not affected by these adjustable mounting assemblies 260, but depend on the torsional rigidity of the primary manifold pipe assembly 36 to maintain the angle set by the non-adjustable center bracket 214. The rods 276 and 287 do not restrain the axial movement of the primary manifold pipe assembly 36 due to thermal expansion or contraction since the rods 276 and 287 bend to allow movement. The slight radial movement of the rods 276 and 287 during thermal excursions does not matter as long as the primary manifold pipe assembly 36 returns to its original position when the temperature returns to normal. The radial position of the adjustable mounting assemblies 260 and primary manifold pipe assembly 36 is adjusted by means of the rods 276 and 287. The object is to make the primary manifold pipe assembly 36 straight and parallel to the valve card box 100.

Clamp assembly 224 is further broken down, as shown on FIG. 4, as a block 293 connected to a small substantially vertical rod 294 and a small transverse rod 295 each having a pair of adjustment hex nuts 296, 297 respectively or equivalent and connected to curved member 298 that is connected to support member 299 that is attached to collector plate support member 86 by conventional mechanical means. Small substantially vertical rod 294 is utilized to restrain angular movement of the collector plate support member 86. A second small transverse rod 295 is utilized to restrain movement of the collector plate support member 86 in a direction parallel to the dye passage outlets 52. This rod 295 is actually twenty-five degrees from the vertical and perpendicular to the collector plate support member 86. As shown in FIG. 3, there is a third small transverse rod 307 inserted through a portion of the pivoting clamp arm 236 with adjustment bolts 308 on each side. This rod 307 is actually twenty-five degrees from the horizontal and parallel to the collector plate support member 86. This small transverse rod 307 is threadedly connected to support member 299 and utilizes a stop nut 310. Small transverse rod 307 is utilized to restrain movement of the collector plate support member 86 in a direction perpendicular to the dye passage outlets 52. These three rods 294, 295 and 307 provide support for the end and intermediate section of the collector plate support member 86 with respect to the primary manifold pipe assembly 36 as well as connecting the clamp assembly 224 on the primary manifold pipe assembly 36 and the collector plate support member 86. Adjustments of the collector plate support member 86 are made by using these three rods 294, 295 and 307. Axial movement is not restrained with thermal excursion resulting in the bending of the rods 294, 295 and 307. Slight radial movement due to this bending of the rods 294, 295 and 307 is inconsequential. These rods 294, 295 and 307 merely are transverse and do not have to be in any particular angle.

The effect of this type of mounting is that axial movement of the primary manifold pipe assembly 36 and the clamp assembly 224 causes the support rods 276 and 287 to bend slightly, which can occur with little stress on the rods 276 and 287 or primary manifold pipe assembly 36. Radial movement of the primary manifold pipe assembly 36 is resisted by the axial stiffness of the rods 276 and 287, which is much greater than the bending stiffness. There is no friction in the system, therefore there is essentially no hysteresis. Likewise, movement of the collector plate support member 86 can occur with regard to the clamp assembly 224.

At assembly, the primary manifold pipe assembly 36 is placed in the single non-adjustable center bracket 214 and clamped. The pipe angle dowel pin 232 locates the primary manifold pipe assembly 36 axially and sets the angle of the submanifold assembly 42. The location and angle of the primary manifold pipe assembly 36 with respect to the valve card box 100 is non-adjustable. However, the location of the valve card box 100 is adjustable by means of the valve card box suspension system. The four adjustable mounting assemblies 260 are attached to the primary manifold pipe assembly 36 and by use of the nuts 280, 281 and 284 respectively on the substantially vertical rod 276 and nuts 289 and 290 on the substantially horizontal rod 287, the primary manifold pipe assembly 36 is made parallel to a corner of the valve card box 100. The primary manifold pipe assembly 36 is relatively stiff, so most of the adjustment is intended to control the parallelism of the primary manifold pipe assembly 36 to the valve card box 100, however, small amounts of bend can be introduced to the primary manifold pipe assembly 36 if needed to correct a lack of straightness. When dimensional changes occur because of temperature differences between the primary manifold pipe assembly 36 and the valve card box 100, the rods 276 and 287 flex to allow relative movement to take place. Since the rods 276 and 287 swing the primary manifold pipe assembly 36 through a small arc during these movements, the radial location of the primary manifold pipe assembly 36 with respect to the valve card box 100 changes. This change is not a problem as long as the primary manifold pipe assembly 36 returns to its original location when temperatures return to normal. The thermal changes occur only during cleaning, and temperatures should be back to normal before printing resumes.

In view of the above, it will be seen that various aspects and features of the invention are achieved and other advantageous results attained. While a preferred embodiment of the invention has been shown and described, it will be clear to those skilled in the art that changes and modifications may be made therein without departure from the invention in its broader aspect.

What is claimed is:

1. An apparatus for applying liquids to a moving substrate comprising means for conveying the substrate in a predetermined path of travel, at least one elongate liquid jet gun bar having a plurality of liquid passage outlets positioned along the liquid jet gun bar for directing liquid in plural streams onto the substrate, and a support means having support elements positioned on the sides of the path of substrate treatment for positioning the liquid jet gun bar across the path, an elongate manifold pipe assembly having a length and outer diameter and having an inlet for receiving liquid for distribution and a plurality of liquid passage outlets spaced along the length of the elongate manifold pipe assembly, means securing the elongate manifold pipe assembly to said liquid jet gun bar comprising of at least one first support means that holds said elongate manifold pipe assembly in a fixed position and at least one second support means that secures the elongate manifold pipe assembly radially while permitting axial movement due to thermal expansion of the elongate manifold pipe assembly and an elongate liquid applicator section connected to said plurality of dye passage outlets for dispensing liquid in plural streams onto said substrate.

2. The apparatus of claim 1, further comprising a means for conducting pressurized air to a point adjacent each of said liquid passage outlets to defect liquid emitted by said liquid passage outlets and a means for preventing said deflected liquid from striking said substrate.

3. The apparatus of claim 2, wherein said first support means further comprises a clamp assembly having an arcuate surface to conform to said outer diameter of said elongate manifold pipe assembly and a pivoting clamp arm having an arcuate surface to secure said elongate manifold pipe assembly against said arcuate surface of said clamp assembly and a means to operatively attach said clamp assembly to said pivoting clamp arm and a means for attaching said clamp assembly to said liquid jet gun bar.

4. The apparatus of claim 3, wherein said means for attaching said clamp assembly to said gun bar further comprises a bracket adapted to be fixed and a means for attaching said bracket to said clamp assembly and a means for attaching said bracket to said liquid jet gun bar.

5. The apparatus of claim 4, wherein said means for preventing said deflected liquid from striking said substrate further comprises a collector plate support member and a means for operatively attaching said collector plate support member to said bracket.

6. The apparatus of claim 2, wherein said first support means further comprises a first pin that is adapted to be received within a recess in the elongate manifold pipe assembly.

7. The apparatus of claim 6, wherein said means to operatively attach said clamp assembly to said pivoting clamp arm further comprises a plate having a second pin located thereon and a means to attach said plate to said clamp assembly.

8. The apparatus of claim 7, wherein said means to operatively attach said clamp assembly to said pivoting clamp arm further comprises a clamp screw to secure said pivoting clamp arm against said elongate manifold pipe assembly.

9. The apparatus of claim 2, wherein said second support means further comprises a support member that is rigid in the radial direction and flexible in the axial direction.

10. The apparatus of claim 9, wherein said support member further comprises a first support rod, a second support rod transverse to said first support rod, a means for attaching said first support rod to said liquid jet gun bar, a means for attaching said second support rod to said liquid jet gun bar, a means for operatively attaching said first support rod to said elongate manifold pipe assembly and a means for operatively attaching said second support rod to said elongate manifold pipe assembly.

11. The apparatus of claim 10, wherein said means for operatively attaching said first support rod to said elongate manifold pipe assembly and said means for operatively attaching said second support rod to said elongate manifold pipe assembly further comprises a bracket and a means for operatively attaching said first support rod to said bracket and a means for operatively attaching said second support rod to said bracket.

12. The apparatus of claim 11, wherein said second support means further comprises a clamp assembly having an arcuate surface to conform to said outer diameter of said elongate manifold pipe assembly and a pivoting clamp arm having an arcuate surface to secure said elongate manifold pipe assembly against said arcuate surface of said clamp assembly and a means to operatively attach said clamp assembly to said pivoting clamp arm and a means for attaching said clamp assembly to said bracket.

13. The apparatus of claim 11, wherein said means to operatively attach said clamp assembly to said pivoting clamp arm further comprises a plate having a second pin located thereon and a means to attach said plate to said clamp assembly.

14. The apparatus of claim 13, wherein said means to operatively attach said clamp assembly to said pivoting clamp arm further comprises a clamp screw to secure said pivoting clamp arm against said elongate dye manifold pipe assembly.

15. The apparatus of claim 11, wherein said means for preventing said deflected liquid from striking said substrate further comprises a collector plate support member and a means for operatively attaching said collector plate support member to said bracket.

16. The apparatus of claim 15, wherein said means for operatively attaching said collector plate support member to said bracket further comprises a support member that is rigid in the radial direction and flexible in the axial direction.

17. The apparatus of claim 16, wherein said means for operatively attaching said collector plate support member to said bracket further comprises a plurality of transverse rods and a means for operatively attaching said transverse rods to said bracket.

18. The apparatus of claim 16, wherein said means for operatively attaching said collector plate support member to said bracket further comprises a first rod and a means for operatively attaching said first rod to said bracket, a second rod transverse to said first rod and a means for operatively attaching said second rod to said bracket, a third rod transverse to said first rod and said second rod and a means for operatively attaching said third rod to said bracket.

19. The apparatus of claim 18, wherein said first rod is substantially vertical, said second rod is substantially perpendicular with respect to said collector plate support member and said third rod is substantially parallel with respect to said collector plate support member.

20. The apparatus of claim 19, wherein said first support rod is substantially vertical and second support rod is substantially horizontal.

21. An apparatus for applying liquids to a moving substrate comprising means for conveying the substrate in a predetermined path of travel, at least one elongate liquid jet gun bar having a plurality of liquid passage outlets positioned along the liquid jet gun bar for directing liquid in plural streams onto the substrate, and support means having support elements positioned on the sides of the path of substrate treatment for positioning the liquid jet gun bar across the path, an elongate manifold pipe assembly having a length and outer diameter and having an inlet for receiving liquid for distribution and a plurality of liquid passage outlets spaced along the length of the elongate manifold pipe assembly, means securing the elongate manifold pipe assembly to said liquid jet gun bar comprising of at least one first support means that holds said elongate manifold pipe assembly in a fixed position and a plurality of second support means that secures the elongate manifold pipe assembly radially while permitting axial movement due to thermal expansion of the elongate manifold pipe assembly and an elongate liquid applicator section connected to said plurality of dye passage outlets for dispensing liquid in plural streams onto said substrate.

22. The apparatus of claim 21, further comprising a means for conducting pressurized air to a point adjacent each of said liquid passage outlets to defect liquid emitted by said liquid passage outlets and a means for preventing said deflected liquid from striking said substrate.

23. The apparatus of claim 22, wherein said first support means further comprises a clamp assembly having an arcuate surface to conform to said outer diameter of said elongate manifold pipe assembly and a pivoting clamp arm having an arcuate surface to secure said elongate manifold pipe assembly against said arcuate surface of said clamp assembly and a means to operatively attach said clamp assembly to said pivoting clamp arm and a means for attaching said clamp assembly to said liquid jet gun bar.

24. The apparatus of claim 23, wherein said means for attaching said clamp assembly to said liquid jet gun bar further comprises a bracket adapted to be fixed and a means for attaching said bracket to said clamp assembly and a means for attaching said bracket to said liquid jet gun bar.

25. The apparatus of claim 24, wherein said means for preventing said deflected liquid from striking said substrate further comprises a collector plate support member and a means for operatively attaching said collector plate support member to said bracket.

26. The apparatus of claim 22, wherein said second support means further comprises a first support rod, a second support rod transverse to said first support rod, a means for attaching said first support rod to said liquid jet gun bar, a means for attaching said second support rod to said liquid jet gun bar, a means for operatively attaching said first support rod to said elongate manifold pipe assembly and a means for operatively attaching said second support rod to said elongate manifold pipe assembly.

27. The apparatus of claim 26, wherein said means for operatively attaching said first support rod to said elongate manifold pipe assembly and said means for operatively attaching said second support rod to said elongate manifold pipe assembly further comprises a bracket and a means for operatively attaching said first support rod to said bracket and a means for operatively attaching said second support rod to said bracket.

28. An apparatus for applying liquids to a moving substrate comprising means for conveying the substrate in a predetermined path of travel, at least one elongate liquid jet gun bar having a plurality of liquid passage outlets positioned along the liquid jet gun bar for directing liquid in plural streams onto the substrate, and a support means having support elements positioned on the sides of the path of substrate treatment for positioning the liquid jet gun bar across the path, an elongate manifold pipe assembly having a length and outer diameter and having an inlet for receiving liquid for distribution and a plurality of liquid passage outlets spaced along the length of the elongate manifold pipe assembly, means securing the elongate manifold pipe assembly to said liquid jet gun bar comprising of a first support means having a pin attached thereto that is received within a recess in the elongate manifold pipe assembly for preventing radial movement of said elongate manifold pipe assembly and further comprising a plurality of second support means securing the elongate manifold pipe assembly allowing axial movement of said elongate manifold pipe assembly and an elongate liquid applicator section connected to said plurality of liquid passage outlets for dispensing liquid in plural streams onto said substrate and a means for conducting pressurized air to a point adjacent each of said liquid passage outlets to defect liquid emitted by said liquid passage outlets and a collector plate support member attached to said elongate manifold pipe assembly by a support member that is rigid in the radial direction and flexible in the axial direction.

* * * * *